US011772123B1

(12) United States Patent
Vancsura et al.

(10) Patent No.: US 11,772,123 B1
(45) Date of Patent: Oct. 3, 2023

(54) PAINT ROLLER STOP DEVICE

(71) Applicants: Tamàs Vancsura, Casper, WY (US); George Dancu, Pittsburgh, PA (US)

(72) Inventors: Tamàs Vancsura, Casper, WY (US); George Dancu, Pittsburgh, PA (US)

( * ) Notice: Subject to any disclaimer, the term of this patent is extended or adjusted under 35 U.S.C. 154(b) by 414 days.

(21) Appl. No.: 17/093,689

(22) Filed: Nov. 10, 2020

Related U.S. Application Data

(60) Provisional application No. 62/934,013, filed on Nov. 12, 2019.

(51) Int. Cl.
*B05C 17/02* (2006.01)

(52) U.S. Cl.
CPC ..... *B05C 17/0222* (2013.01); *B05C 17/0245* (2013.01)

(58) Field of Classification Search
CPC ..... B05C 17/02; B05C 17/021
See application file for complete search history.

(56) References Cited

U.S. PATENT DOCUMENTS 3,088,152 A 5/1963 George et al.
3,175,241 A 3/1965 Singleton et al.
3,369,269 A 2/1968 Fritz et al.
3,790,984 A 2/1974 Spransy et al.
D290,214 S 6/1987 Nellis
D456,146 S 4/2002 Ver Haar
8,332,988 B2 * 12/2012 Sweeney ..... B05C 17/0245 15/230.11
9,364,850 B1 * 6/2016 Anderson ..... B05C 17/0245
2001/0049852 A1 * 12/2001 Burns ..... B05C 17/02 427/428.13
2005/0011032 A1 * 1/2005 Bosler ..... B05C 17/0237 492/19
2011/0123718 A1 * 5/2011 Weis ..... B05C 17/02 427/428.01
2011/0131745 A1 * 6/2011 Sweeney ..... B05C 17/0245 15/230.11
2017/0087583 A1 * 3/2017 Rajala ..... B05C 17/0225

* cited by examiner

*Primary Examiner* — Michael D Jennings
(74) *Attorney, Agent, or Firm* — Thomas M. Joseph, Esq

(57) ABSTRACT

A stopper has an elongated body an upper edge and a lower edge displaced from one another along an extended axis that is essentially perpendicular to the upper edge and the lower edge. A weight attaches to the elongated arm essentially adjacent to the lower edge. An attachment assembly has an elongated shaft and a fastener for attaching the elongated shaft to the frame support member in an essentially overlying relation thereto with a proximal end being closer to the handle than the distal end. The stopper pivotally attaches to the elongated shaft distal end between the upper edge and the lower edge with the weight balancing the rotation of the stopper relative to the elongated shaft to maintain a constant angle between the stopper elongated body extended axis and the surface.

20 Claims, 12 Drawing Sheets

PAINT ROLLER STOP DEVICE

CROSS REFERENCE TO RELATED APPLICATION

This application claims the benefit under 35 U.S.C. § 119(e) of U.S. Provisional Application No. 62/934,013 entitled "PAINT ROLLER STOP DEVICE" filed Nov. 12, 2019, which is incorporated herein by reference.

BACKGROUND

Paint rollers, paint roller frames, and roller covers are known in the art. Paint rollers can include "single frame" paint rollers and "double frame" paint rollers. A typical single frame paint roller includes a handle graspable by the user by which to paint surfaces. A shank extends from the handle with a "C"-shaped frame with a lower horizontal support, a vertical support and an upper horizontal support. A cage is rotatably attached to the upper horizontal support to provide a means upon which a roller cover is disposed. In grasping the handle, the user can sop up paint from a tray and apply the paint to a generally flat surface in a rolling fashion.

A typical double frame paint roller includes a "Y"-shaped frame with a lower horizontal support and a pair of vertical supports connecting to the lower horizontal support to form the "Y". An upper horizontal support connects other ends of the vertical supports to one another. The roller mounts on the upper horizontal support in the same manner as described for the single frame paint roller.

Paint rollers are typically used in situations where this is a relatively large, generally flat surface to be painted, and the paint can be applied by the paint rollers in an effective and efficient manner. Such instances include, but are not limited to, the painting of flat interior walls or ceilings. However, as the roller itself is round, the actual surface upon which the paint is being applied is not necessarily directly beneath the outer radius of the roller.

A gap between adjacent adjoining surfaces oftentimes results when using paint rollers. To minimize this gap, painters will try to paint as close to the abutting adjacent surface as possible which, if not extremely careful, could result in the roller being positioned too far such that the roller cover comes into contact with the adjacent surface and the unintentional application of paint thereon. This is often problematic in situations where it is difficult to judge the remaining distance between the paint roller cover and the adjacent surface.

Additionally, conventional paint rollers, typically, allow the user to accidentally bump the ceiling or ceiling trim when painting adjacent walls. Such accidental bumping of the ceiling often creates the need for a full repainting of the ceiling or ceiling trim molding leading to lost productivity, time, and money and increased frustration for both the professional or casual painter. The potential to accidentally bump the ceiling is further increased when using an extension pole connected to the frame handle, as the user's line of sight is impaired when the roller cover is at heights above the user height, making it more difficult to judge the paint safety zone from the ceiling or trim.

Thus, there is a need for an improved system that would provide greater utility and convenience to allow the user to paint the wall with consistent spacing from ceiling trim or from the ceiling and to prevent accidental bumping of same with a paint-charged roller.

SUMMARY

The following summary is provided to introduce a selection of concepts in a simplified form that are further described below in the detailed description. This summary is not intended to identify key features or essential features of the claimed subject matter, nor is it intended to be used to limit the scope of the claimed subject matter.

In various implementations, a stop device can be used with a paint roller frame to prevent unwanted contact of a paint roller with a surface adjacent to a surface being painted, wherein the frame includes a handle and a support member extending therefrom. A stopper has an elongated body, an upper edge, and a lower edge, with the upper edge and the lower edge being displaced from one another and being essentially perpendicular to an extended axis along the length of the extended body. A weight attaches to the elongated arm essentially adjacent to the lower edge. An attachment assembly has an elongated shaft and a fastener for attaching the elongated shaft to the frame support member in an essentially overlying relation thereto with a proximal end being closer to the handle than the distal end. The stopper pivotally attaches to the elongated shaft distal end between the upper edge and the lower edge with the weight balancing the rotation of the stopper relative to the elongated shaft to maintain a constant angle between the stopper elongated body extended axis and the surface.

In other implementations, a method is provided for assembling a stop device for use with a paint roller frame to prevent unwanted contact of a paint roller with a surface adjacent to a surface being painted, wherein the frame includes a handle and a support member extending therefrom. The elongated shaft is mounted to the frame support member in an essentially overlying relation thereto with a proximal end being closer to the handle than the distal end. A stopper has an elongated body, an upper edge, and a lower edge, with the upper edge and the lower edge being displaced from one another and being essentially perpendicular to an extended axis is pivotally attached to the elongated shaft distal end between the upper edge and the lower edge. A weight is attached to the stopper elongated body lower edge to balance the rotation of the stopper relative to the elongated shaft to maintain a constant angle between the stopper elongated body extended axis and the surface.

In yet other implementations, kit can be used with a paint roller frame to prevent unwanted contact of a paint roller with a surface adjacent to a surface being painted, wherein the frame includes a handle and a support member extending therefrom. A stopper has an elongated body, an upper edge, and a lower edge, with the upper edge and the lower edge being displaced from one another and being essentially perpendicular to an extended axis along the length of the extended body. A weight can be attached to the elongated arm essentially adjacent to the lower edge. An attachment assembly has an elongated shaft and a fastener for attaching the elongated shaft to the frame support member in an essentially overlying relation thereto with a proximal end being closer to the handle than the distal end. The stopper has the ability to pivotally attach to the elongated shaft distal end between the upper edge and the lower edge with the weight balancing the rotation of the stopper relative to the elongated shaft to maintain a constant angle between the stopper elongated body extended axis and the surface.

These and other features and advantages will be apparent from a reading of the following detailed description and a review of the appended drawings. It is to be understood that the foregoing summary, the following detailed description and the appended drawings are explanatory only and are not restrictive of various aspects as claimed.

DETAILED DESCRIPTION

Figure 1:
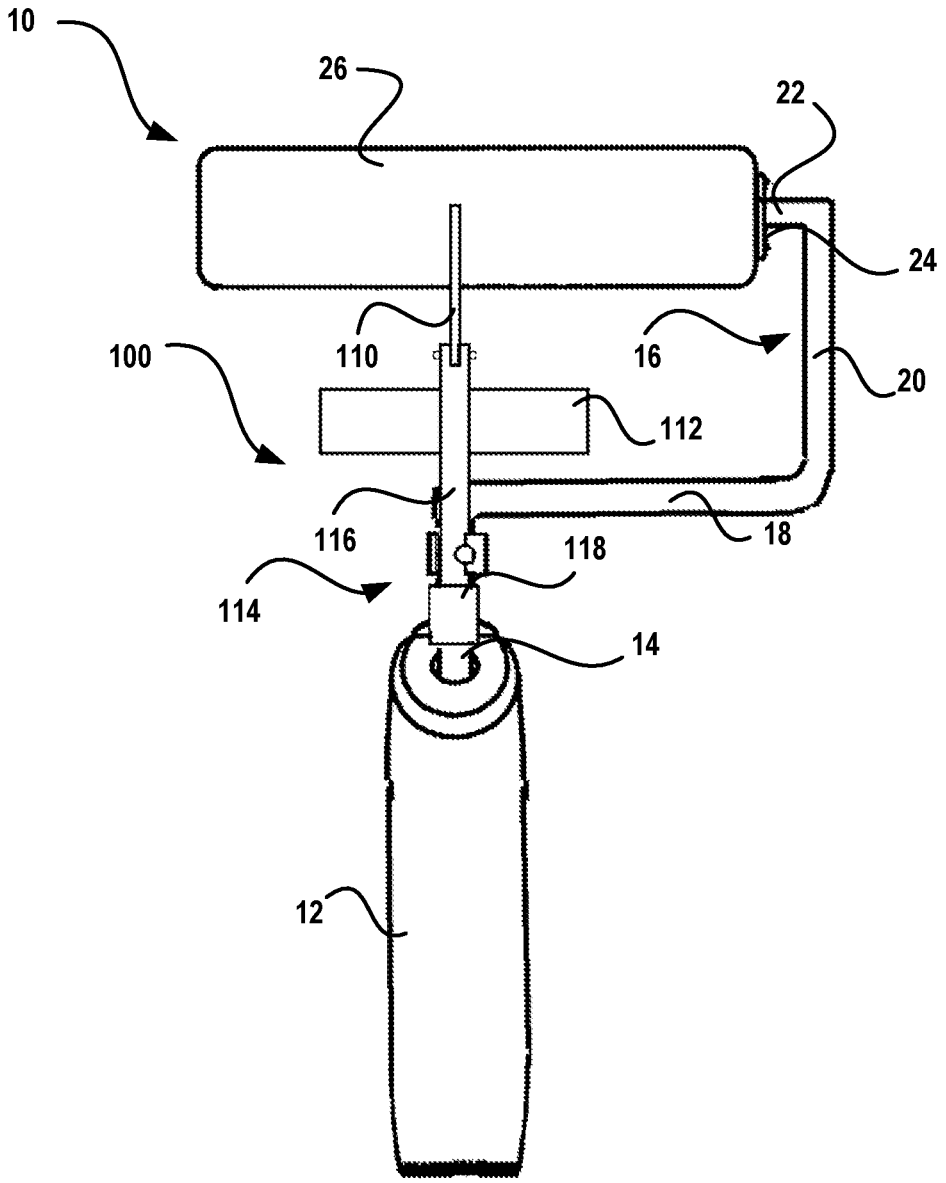
FIG. 1 is a top plan view of an embodiment of a stop device mounted on a single frame paint roller in accordance with the disclosure.

The subject disclosure is directed to a paint roller stop device. More specifically, the subject disclosure is directed to a paint roller stop device having a pivotally attached elongated stopper that maintains a constant, spaced-apart relationship with a painting surface when the stop device moves in a vertical direction. The stop device can be sold in an assembled form or in a kit.

The detailed description provided below in connection with the appended drawings is intended as a description of examples and is not intended to represent the only forms in which the present examples can be constructed or utilized. The description sets forth functions of the examples and sequences of steps for constructing and operating the examples. However, the same or equivalent functions and sequences can be accomplished by different examples.

References to "one embodiment," "an embodiment," "an example embodiment," "one implementation," "an implementation," "one example," "an example" and the like, indicate that the described embodiment, implementation or example can include a particular feature, structure or characteristic, but every embodiment, implementation or example can not necessarily include the particular feature, structure or characteristic. Moreover, such phrases are not necessarily referring to the same embodiment, implementation or example. Further, when a particular feature, structure or characteristic is described in connection with an embodiment, implementation or example, it is to be appreciated that such feature, structure or characteristic can be implemented in connection with other embodiments, implementations or examples whether or not explicitly described.

Numerous specific details are set forth in order to provide a thorough understanding of one or more embodiments of the described subject matter. It is to be appreciated, however, that such embodiments can be practiced without these specific details.

Various features of the subject disclosure are now described in more detail with reference to the drawings, wherein like numerals generally refer to like or corresponding elements throughout. The drawings and detailed description are not intended to limit the claimed subject matter to the particular form described. Rather, the intention is to cover all modifications, equivalents and alternatives falling within the spirit and scope of the claimed subject matter.

The stop device is an assembly that attaches to a paint roller. The roller stopper prevents the roller from hitting the ceiling or the crown molding. The primary advantage of the stop device is that it stops the roller at the same exact distance every single time. This provides a top paint line that can be as close to the corners and as straight as possible. The stop device speeds up the "cutting in" and rolling process and helps create consistency, while avoiding the use of ladders. The stop device is adjustable based on how close a painter wants to get to a ceiling. The stop device is suitable for residential uses and commercial use and can be operated by homeowners or professionals.

Referring now to FIG. 1, there is shown a typical paint roller assembly, generally designated by the numeral 10, that includes a handle 12 which is graspable by the user by which to paint surfaces. A lower vertical support 14 extending from the handle 12 is part of an extended "C"-shaped frame 16 with the lower vertical support 14, a lower horizontal support 18, an upper vertical support 20 and an upper horizontal support 22. A cage 24 rotatably attached to the upper horizontal support 22 provides a means upon which a roller cover 26 is disposed. In grasping the handle 12, the user is able to sop up paint from a tray (not shown), and then apply the paint to a generally flat surface, such as a wall, in a back-and-forth rolling fashion, as is generally known in the art.

As shown in FIG. 1, a paint roller stop device, generally designated by the numeral 100, that is particularly adapted for preventing paint rollers from hitting the ceiling or the crown molding during painting operations connects to the paint roller 10. The paint roller stop device 100 includes a stopper 110, a weight 112, and an attachment assembly 114. The attachment assembly 114 includes an elongated shaft 116 and a fastener 118. The fastener 118 releasably attaches the elongated shaft 116 to the lower frame support 14. The paint roller stop device 100 can be disassembled for easy cleaning.

The stop device 100 is used with a paint roller frame 16 to prevent unwanted contact of the roller cover 26 with a surface adjacent to a surface being painted. The stopper 110 pivotally attaches to the elongated shaft 116 with the weight 112 balancing the rotation of the stopper 110 relative to the elongated shaft 116. The weight 112 provides the stopper 110 with the ability to maintain a constant, spaced-apart relationship with a painting surface when the stop device 100 moves in a vertical direction with the paint roller assembly 10. The pivotal attachment and balancing action prevent the stopper 110 from being dipped in paint when the roller cover 26 is dipped in paint by the paint roller assembly 10, unlike conventional stop devices.

In the above described configuration, the stopper 110 extends over the paint roller cover 26. The use of the elongated shaft 116 and the fastener 118 provides the stopper 110 with the ability to extend over a middle portion of the paint roller cover 26. This is another difference between the stop device 100 and conventional paint stoppers. Additionally, the positioning of the stopper 110 over the roller cover 26 makes it more difficult for the stopper 110 to accidentally touch a paint surface when in use.

The configuration of the attachment assembly 114 and, specifically, the elongated shaft 116 and the fastener 118, can be altered to accommodate paint roller frames 16 that are not substantially "C"-shaped, as are known in the art. Those skilled in the art will readily recognize that such alternate configurations are well within the scope of the disclosure.

It should further be understood that the fastener 118 can be eliminated in some embodiments when the elongated shaft 116 and the frame 16 are unitary, integral, or permanently joined to one another.

Figure 2:
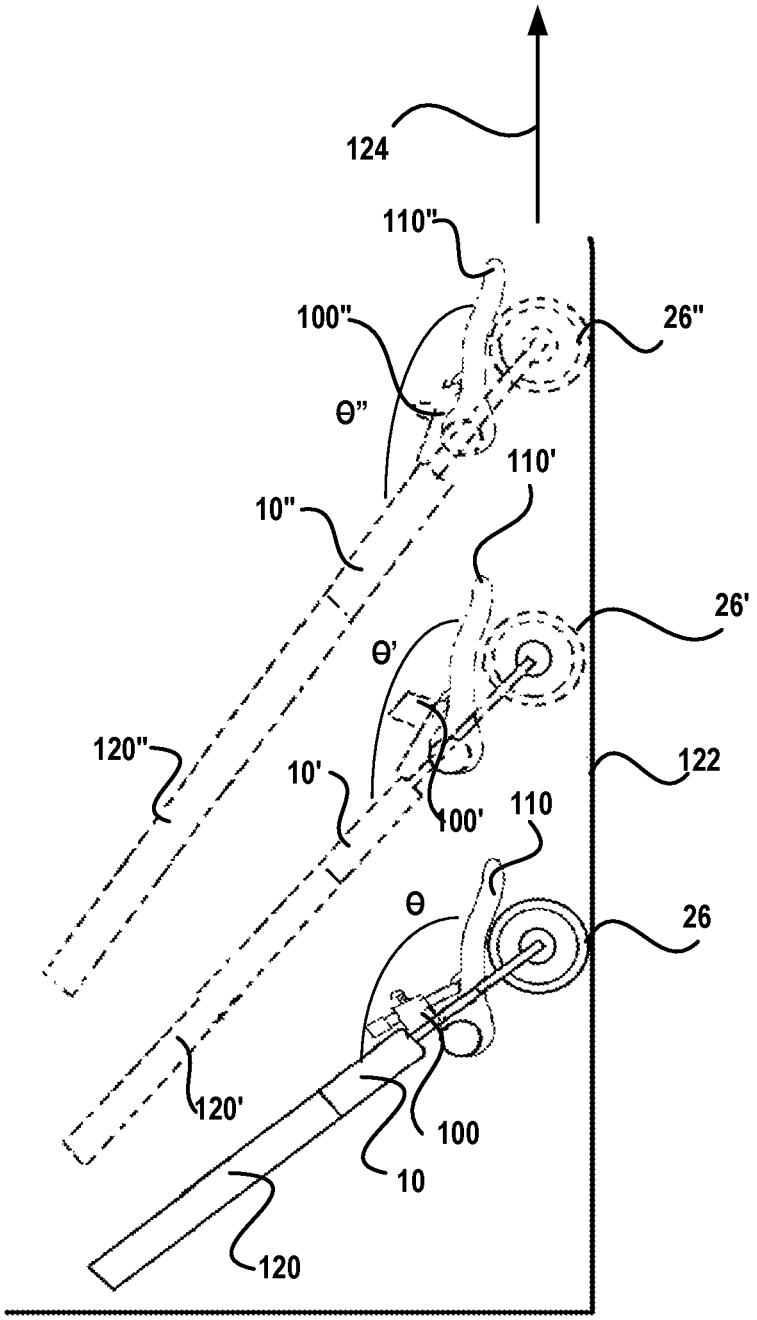
FIG. 2 is a side view of the stop device shown in FIG. 1 in operation.

Referring now to FIG. 2 with continuing reference to the foregoing figures, the operation of the stop device 100 shown in FIG. 1 is illustrated. The stop device 100 can be used in conjunction with the paint roller assembly 10 shown in FIG. 1. In this exemplary embodiment, the paint roller assembly 10 is connected to an extension 120.

In operation, the paint roller cover 26 contacts a surface 122 that is being painted. The stopper 100 pivotally attaches to the stop device 100 and is aligned along the axis 124. The axis 124 is essentially parallel to the surface 122.

Two alternate configurations of the paint roller assembly 10, the stop device 100, and the extension 120 are shown in phantom. One configuration includes the designations for the paint roller assembly 10', the stop device 100', and the extension 120'. A second configuration includes the designations for the paint roller assembly 10", the stop device 100", and the extension 120".

The angle of the extension 120 relative to the stopper 110 is represented as θ. The angle of the extension 120' relative to the stopper 110' is represented as θ'. The angle of the extension 120" relative to the stopper 110" is represented as θ".

As shown in FIG. 2, the angle θ increases to the angle θ" as the paint roller cover is moved from the position of the paint roller cover 26 to the paint roller cover 26". However, the stopper 110, the stopper 110', and the stopper 110" maintain a configuration that is fixed about the axis 124, which is essentially parallel to the surface 122. The alignment is provided by the balancing of the pivotally mounted stopper 110 with the weight 112.

Figure 3:
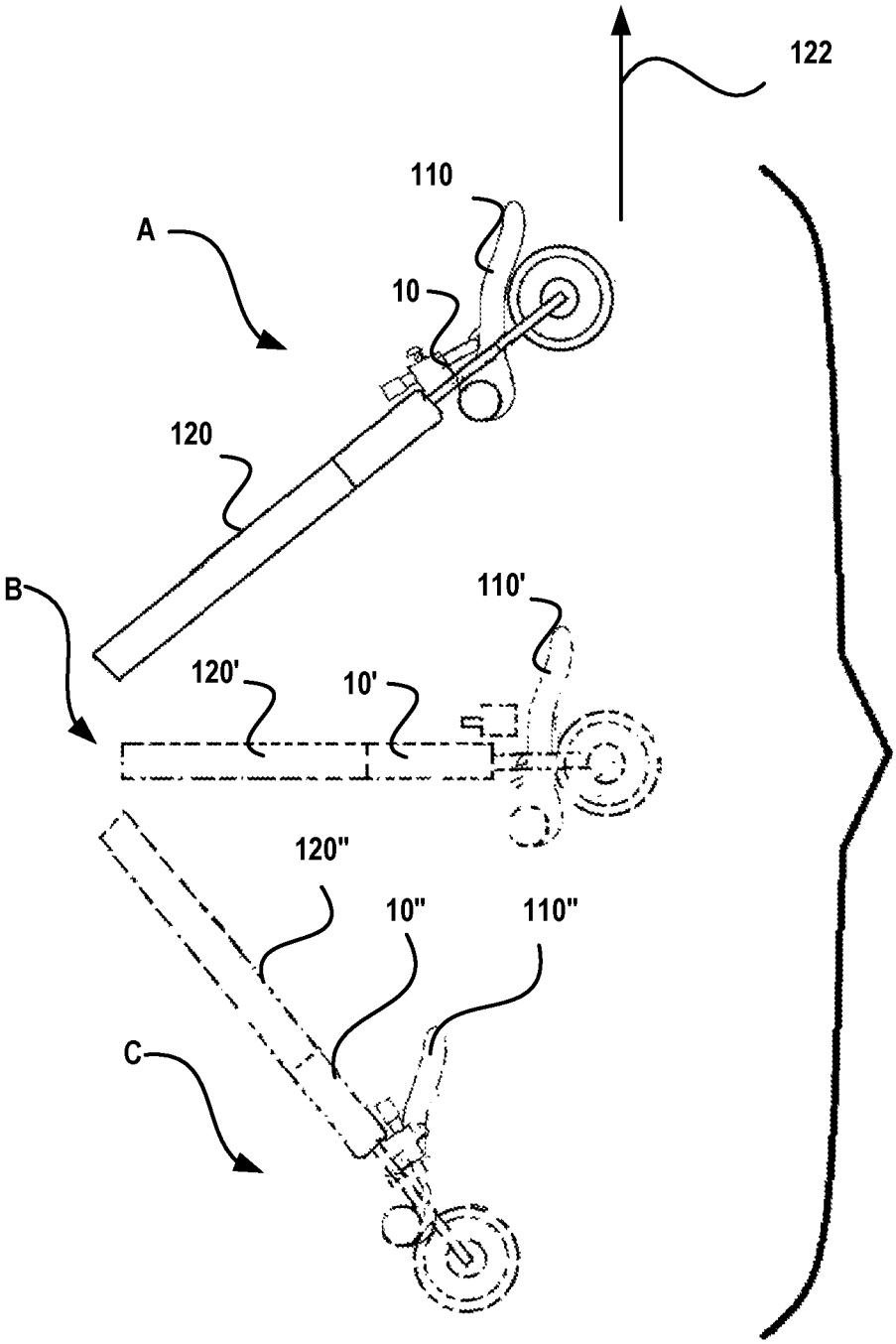
FIG. 3 is another side view of the stop device shown in FIG. 1 in operation.
Figure 4:
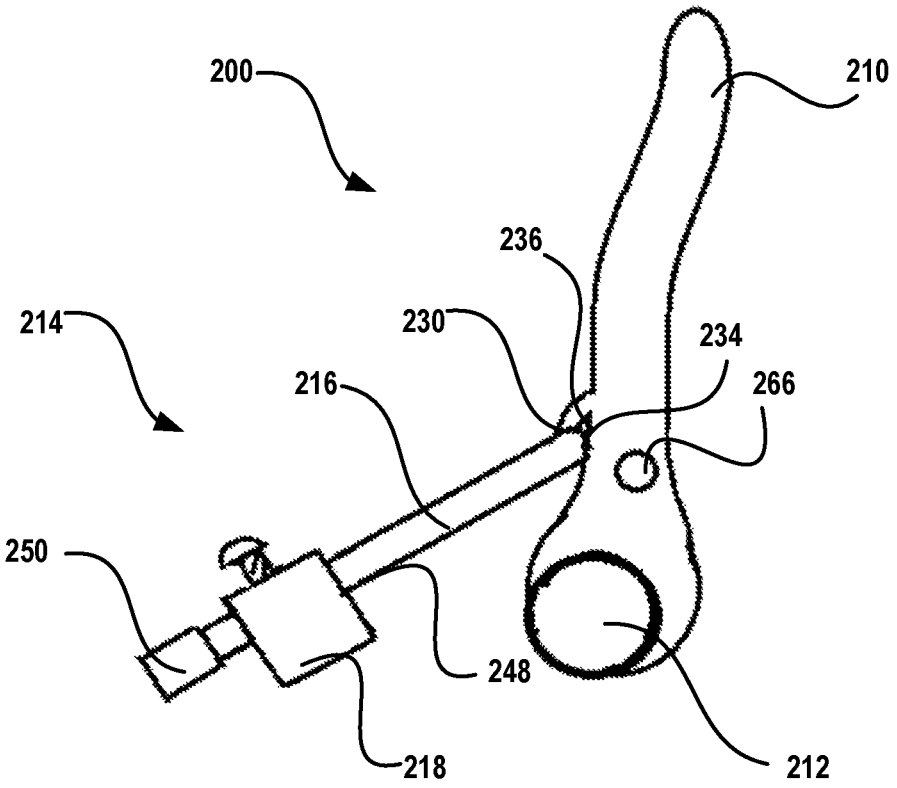
FIG. 4 is a side view of another embodiment of a stop device mounted on a single frame paint roller.
Figure 5:
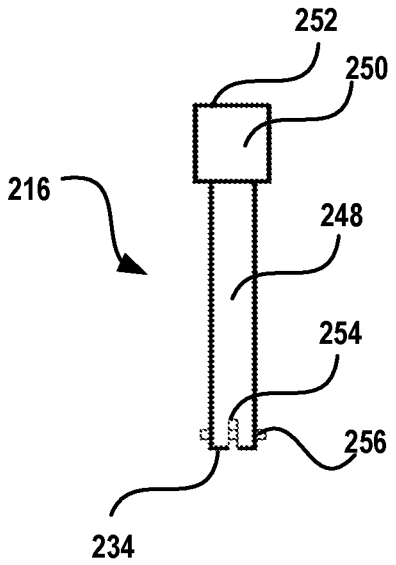
FIG. 5 is a top plan view of an elongated shaft that is a component of the stop device shown in FIG. 4.
Figure 6:
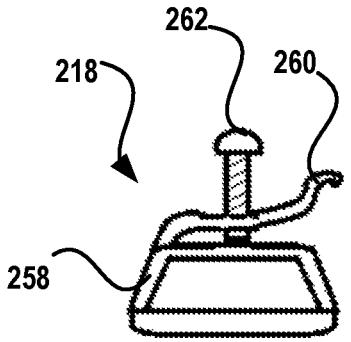
FIG. 6 is a front view of a fastening device that is a component of the stop device shown in FIG. 4.
Figure 7:
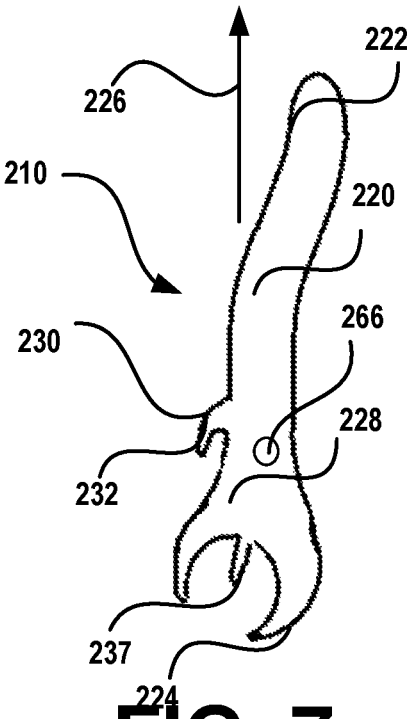
FIG. 7 is a side view of a stopper that is a component of the stop device shown in FIG. 4.
Figure 8:
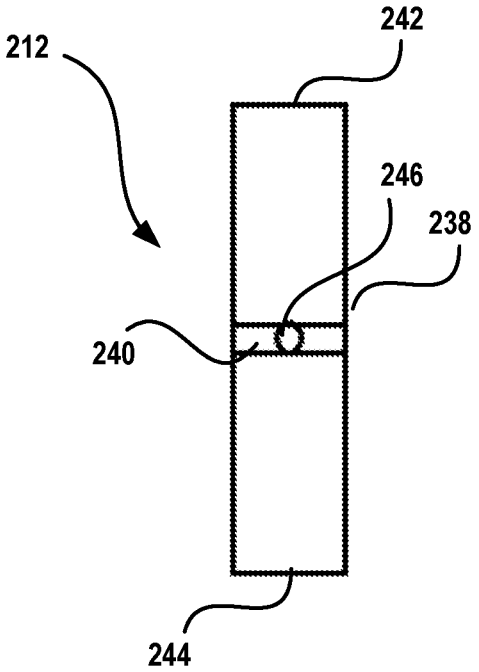
FIG. 8 is a top plan view of a weight that is a component of the stop device shown in FIG. 4.

Referring now to FIG. 3 with continuing reference to the foregoing figures, another depiction of the operation of the stop device 100 shown in FIG. 1 is illustrated. The stop device 100 can be used in conjunction with the paint roller assembly 10 shown in FIG. 1. In this exemplary embodiment, the paint roller assembly 10 is connected to an extension 120.

Unlike the depiction shown in FIG. 2, the stop device 100 is shown in three different configurations A-C with respect to the extension 120. In configuration A, the extension 120 is positioned below the paint roller assembly 10. In configuration B, the extension 120' is positioned at essentially the same height as the paint roller assembly 10'. In configuration C, the extension 120" is positioned above the paint roller assembly 10". In all three configurations A-C, to the stop devices 100, 100', and 100" are aligned along the axis 122.

Referring now to FIGS. 4-8 with continuing reference to the foregoing figures, there is shown another embodiment of a paint roller stop device, generally designated by the numeral 200. The paint roller stop device 200 is essentially identical to the embodiment of the paint roller stop device 100 shown in FIGS. 1-3. The paint roller stop device 200 is shown in assembled form in FIG. 4 without a paint roller assembly, such as the paint roller assembly 10 shown in FIGS. 1-3.

Like the embodiment shown in FIGS. 1-3, the paint roller stop device 200 includes a stopper 210, a weight 212, and an attachment assembly 214. The attachment assembly 214 includes an elongated shaft 216 and a fastener 218. The stopper 210 has an elongated body 220 with an upper edge 222 and a lower edge 224 being displaced from one another along an extended axis 226 that is essentially perpendicular to the upper edge 222 and the lower edge 224.

The lower edge 224 defines an arcuate indentation 228 for receiving the weight 212. The elongated body 220 includes a curved extension 230 that includes a circular recession 232 that receives a distal end 234 of the elongated shaft 216, which pivotally attaches the elongated shaft 216 to the stopper 210. Through the attachment, the stopper 210 has the ability to pivot about a pivot point 236. In some embodiments, the stopper 210 can include a spike 237 that provides additional stability for the stopper 210 relative to the weight 212.

The weight 212 releasably attaches to the stopper 210 to provide the stopper 210 with the ability to maintain a constant angle between the extended axis 226 and a vertical painting surface, such as the surface 122 shown in FIG. 2, when the stop device 200 is in use. The weight 212 has an essentially cylindrical shaped body 238 with an extended channel 240 bisecting the body 238 into two halves 242-244. The weight 212 has a bore 246 therein.

The elongated shaft 216 includes an elongated body 248 and a cap 250 at a proximal end 252. In this exemplary embodiment, the body 248 is substantially longer than the cap 250 and has a smaller width than the body 248. The distal end 234 is bifurcated to define a slot 254 with a pin 256 to extend therethrough.

The pin 256 facilitates the pivotal attachment of the stopper 210 to the elongated shaft 216. In some embodiments, the cap 250 can be removed from body 248 and placed on the distal end 234 to prevent paint from getting into the slot 254.

The fastener 218 is a conventional fastening mechanism. In this exemplary embodiment, the fastener 218 is a as that includes a tubular section 258, a gripping section 260, and an adjustment mechanism 262. The tubular section 258 is particularly adapted to receive supports for a paint roller frame 16 shown in FIG. 1. The gripping section 260 is particularly adapted to grip the elongated shaft 216 to connect the stop device 200 to a paint roller frame 16. The adjustment mechanism 262 is a screw that can facilitate connection of the stop device 200 to the paint roller frame 16.

Figure 9:
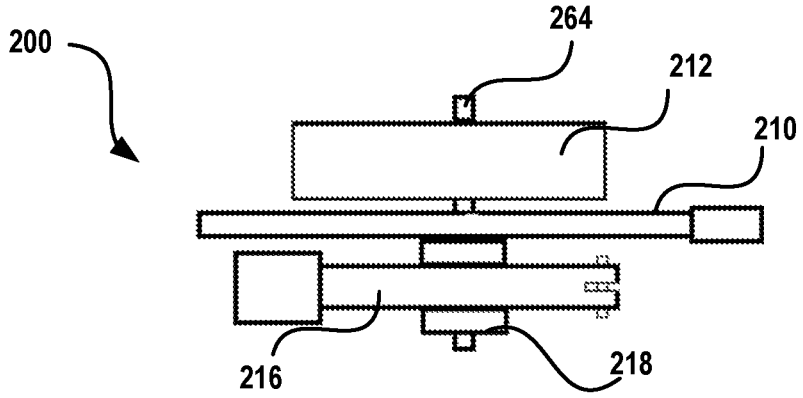
FIG. 9 is a side view of the stop device shown in FIG. 4 in storage

The stopper 210, the weight 212, the elongated shaft 216, and the fastener 218 can be made from any suitable material through any suitable manufacturing method. Suitable materials include flexible, rigid, or semi-rigid materials. Suitable materials also include metals, ceramics, plastics, and composites. In this exemplary embodiment, the weight 212, the elongated shaft 216, and the fastener 218 are made from metal. The stopper 210 is made from rigid plastic. In some embodiments, the stopper 210 is made from a disposable plastic since the stopper 210 can be covered with paint through successive uses Referring now to FIG. 9 with continuing reference to the foregoing figures, the paint roller stop device 200 in shown in a folded configuration for storage. The paint roller stop device 200 is essentially identical to the embodiment of the paint roller stop device 100 shown in FIGS. 1-3.

In this folded configuration, the stopper 210 is positioned between the weight 212 and the elongated shaft 216. The fastener 218 is mounted on the elongated shaft 216. A pin 264 extends through the bore 246 shown in FIG. 8 and a bore 266 shown in FIG. 7. In some embodiments, the pin 264 can be used to attach the stop device 200 to a roller assembly, such as roller assembly 10 shown in FIG. 1, for storage.

Figure 10:
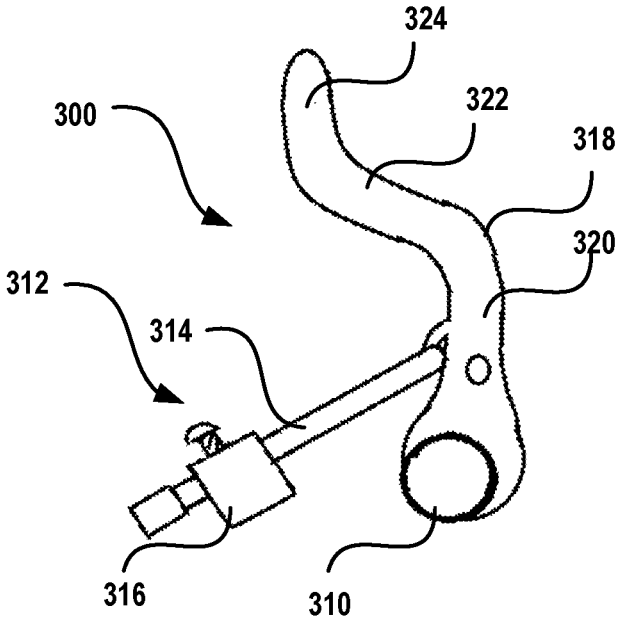
FIG. 10 is a side view of a stopper that is configured for painting surfaces that include crown molding.

Referring now to FIG. 10 with continuing reference to the foregoing figures, there is shown another embodiment of a paint roller stop device, generally designated by the numeral 300. Like the embodiment shown in FIGS. 1-9, the paint roller stop device 300 includes a weight 310 and an attachment assembly 312. The attachment assembly 312 includes an elongated shaft 314 and a fastener 316.

Unlike the embodiment shown in FIGS. 1-9, the stop device 300 includes a stopper 318 particularly adapted to avoid crown molding that projects from paint surfaces. The stopper 318 includes a body 320, an extension 322, and a tip 324. The extension 322 connects the tip 324 to the body 320 in a manner that allows the tip 324 to avoid touching crown molding during painting operations.

Figure 11:
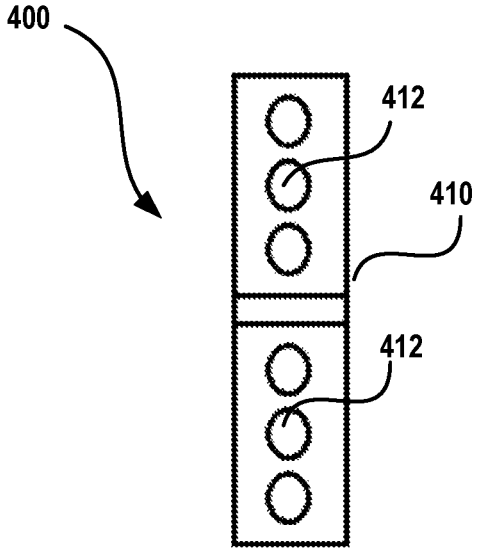
FIG. 11 is a top plan view of another embodiment of a weight that is a component of the stop device shown in FIG. 4.

Referring now to FIG. 11 with continuing reference to the foregoing figures, there is shown another embodiment of a weight, generally designated by the numeral 400. Like the embodiment shown in FIG. 8, the weight 400 includes a cylindrical body 410. Unlike the embodiment shown in FIG. 8, the body 410 includes a plurality of bores 412 extending therethrough. The bores 412 can reduce the weight of the weight 400.

Figure 12:
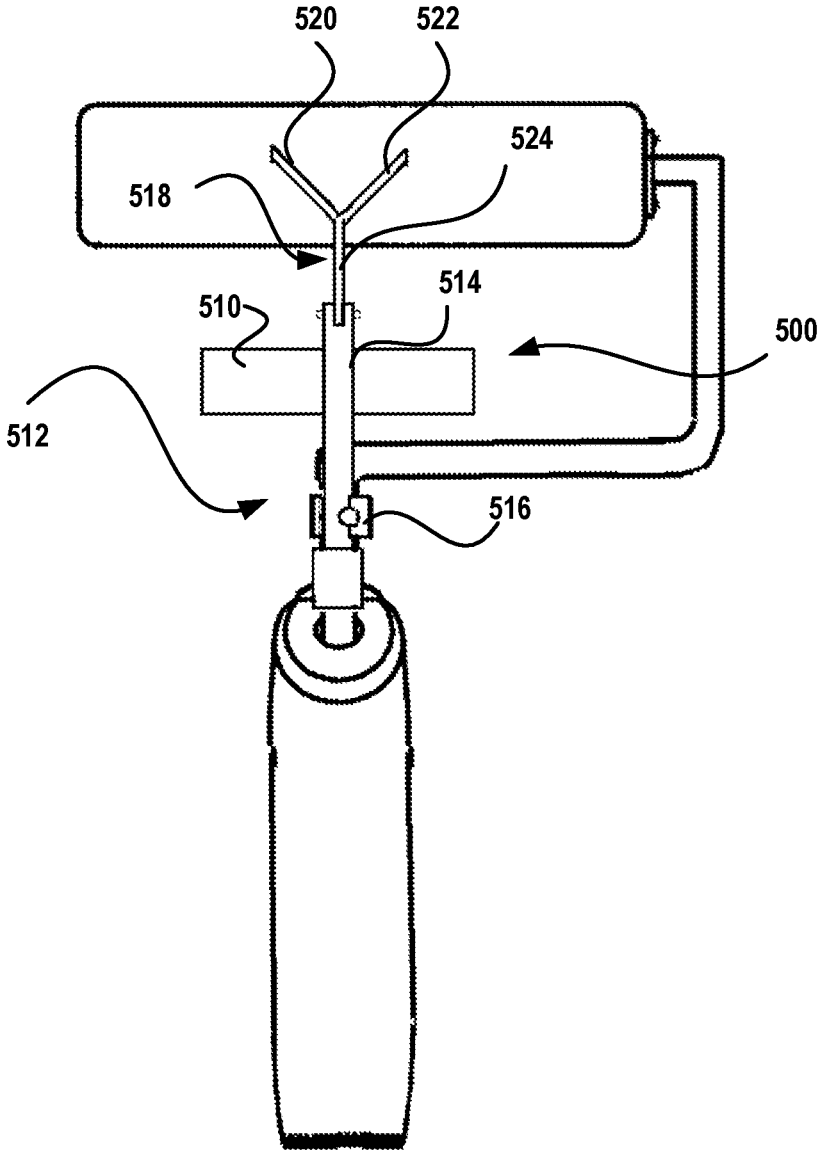
FIG. 12 is a top plan view of another embodiment of a stop device mounted on a single frame paint roller.

Referring now to FIG. 12 with continuing reference to the foregoing figures, there is shown another embodiment of a paint roller stop device, generally designated by the numeral 500, mounted on the paint roller assembly 10 shown in FIG. 1. Like the embodiment shown in FIGS. 1-9, the paint roller stop device 500 includes a weight 510 and an attachment assembly 512. The attachment assembly 512 includes an elongated shaft 514 and a fastener 516.

Unlike the embodiment shown in FIGS. 1-9, the stop device 500 includes a stopper 518 having an essentially "Y" shaped configuration in which two members 520-522 extend from a body 524. The "Y" shaped configuration provides the paint roller stop device 500 with additional stability when a portion of the stopper 518 extends over a roller cover, such as the roller cover 26 shown in FIG. 1. It should be understood that, in some embodiments, the members 520-522 can be a unitary structure that forms an essentially planar triangular-shaped structure.

Figure 13:
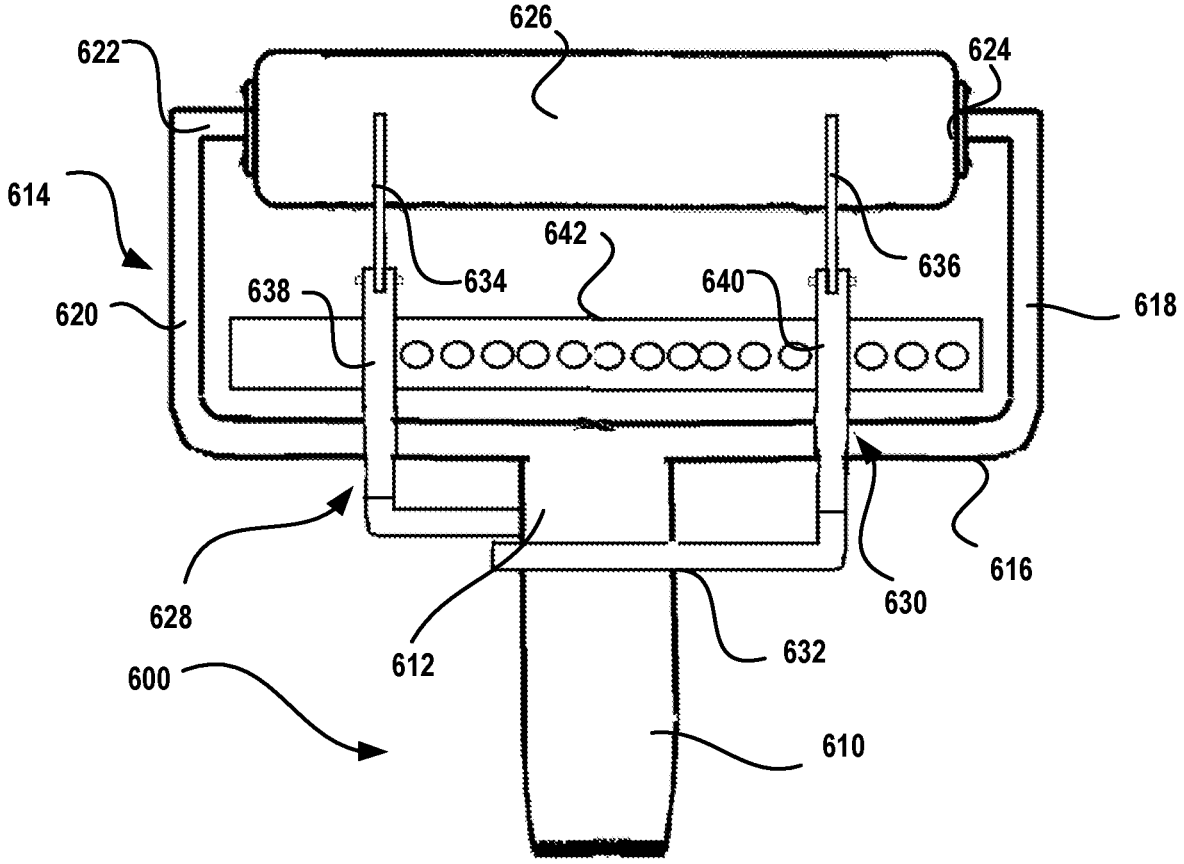
FIG. 13 is a top plan view of a pair of stop devices mounted on a double frame paint roller.

Referring now to FIG. 13 with continuing reference to the foregoing figures, there is shown a double frame paint roller assembly, generally designated by the numeral 600. The double frame roller assembly 600 includes a handle 610 which can receive an extension, such as the extension 120 shown in FIG. 122.

A lower vertical support 612 extends from the handle 610. The lower vertical support 612 is part of a "Y"-shaped frame 614 with a lower horizontal support 616, a pair of upper vertical supports 618-620 and an upper horizontal support 622. A cage 624 rotatably attached to the upper horizontal support 622 provides a means upon which a roller cover 626 is disposed.

A pair of paint roller stop devices, generally designated by the numerals 628 and 630, are mounted on a connecting device 632 in a spaced-apart relationship. The paint roller stop devices 628-630 include stoppers 634-636 and elongated shafts 638-640. The stoppers 634-636 are essentially identical to the stopper 110 shown in FIGS. 1-2 and/or the stopper 210 shown in FIGS. 3 and 6. The elongated shafts 638-640 are essentially identical to the elongated shaft 116 shown in FIG. 1 and/or the elongated shaft 216 shown in FIGS. 3-4.

Unlike the embodiments shown in FIGS. 1-9, the paint roller stop devices 628-630 are connected by an elongated weight 642. The elongated weight 642 provides the stoppers 634-636 with the ability to pivot in unison. The elongated shafts 638-640 and/or the connecting device 632 can connect to the lower horizontal support 616 using suitable fastening mechanisms, such as clips, clamps, clasps, magnets, and other similar fastening mechanisms. In this exemplary embodiment, the connecting device 632 includes a hoop 644 through which the lower vertical support 612 can be inserted.

Figure 14:
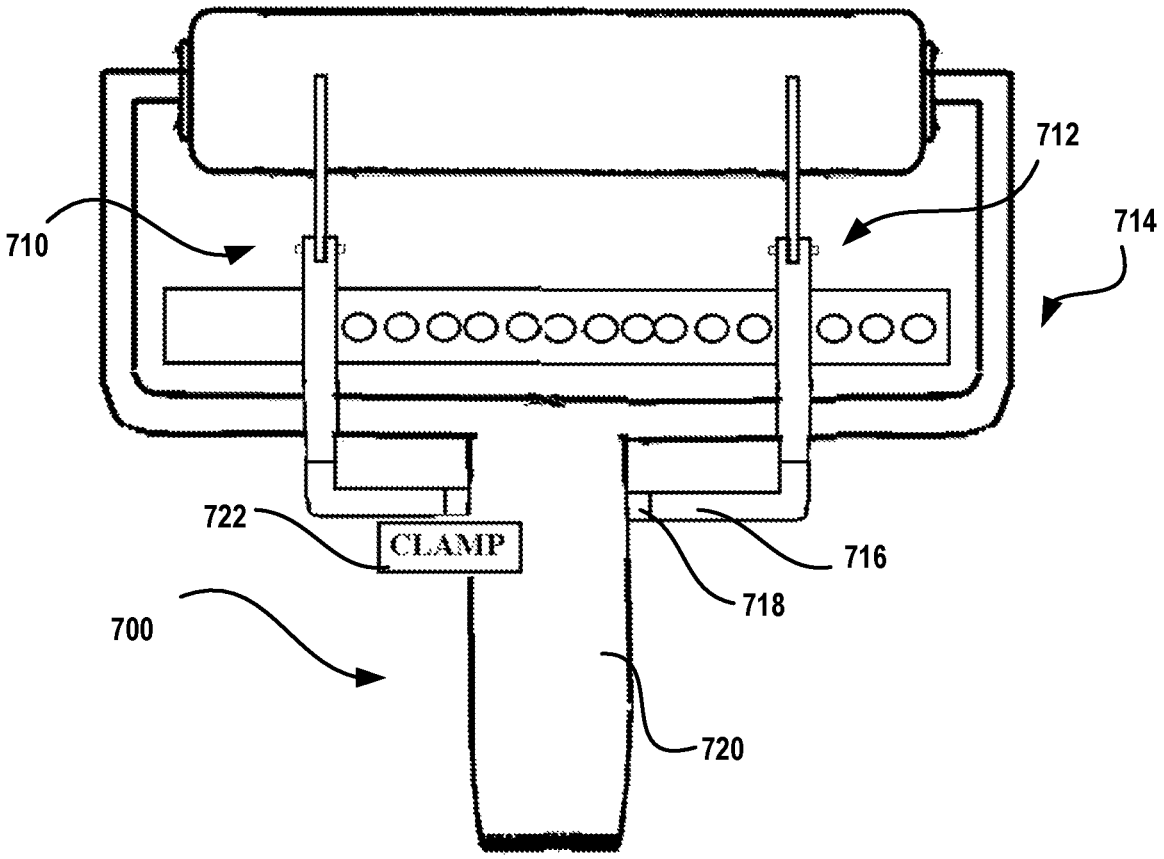
FIG. 14 is a top plan view of another embodiment of pair of stop devices mounted on a double frame paint roller.

Referring now to FIG. 14 with continuing reference to the foregoing figures, there is shown another embodiment of a double frame roller assembly, generally designated by the numeral 700. Like the embodiment shown in FIG. 13, the double frame roller assembly 700 includes a pair of roller stop devices 710-712 that are essentially identical to the roller stop devices 628-630 shown in FIG. 13. The roller stop devices 710-712 are mounted on a frame 714.

Unlike the embodiment shown in FIG. 13, the roller stop devices 710-712 can be connected to one another with a connecting device 716 that includes an indentation 718 that can engage a lower vertical support 720 in the frame 714. The connecting device 716 can connect to the frame 714 using a clamp 722 or other similar fastener.

Figure 15:
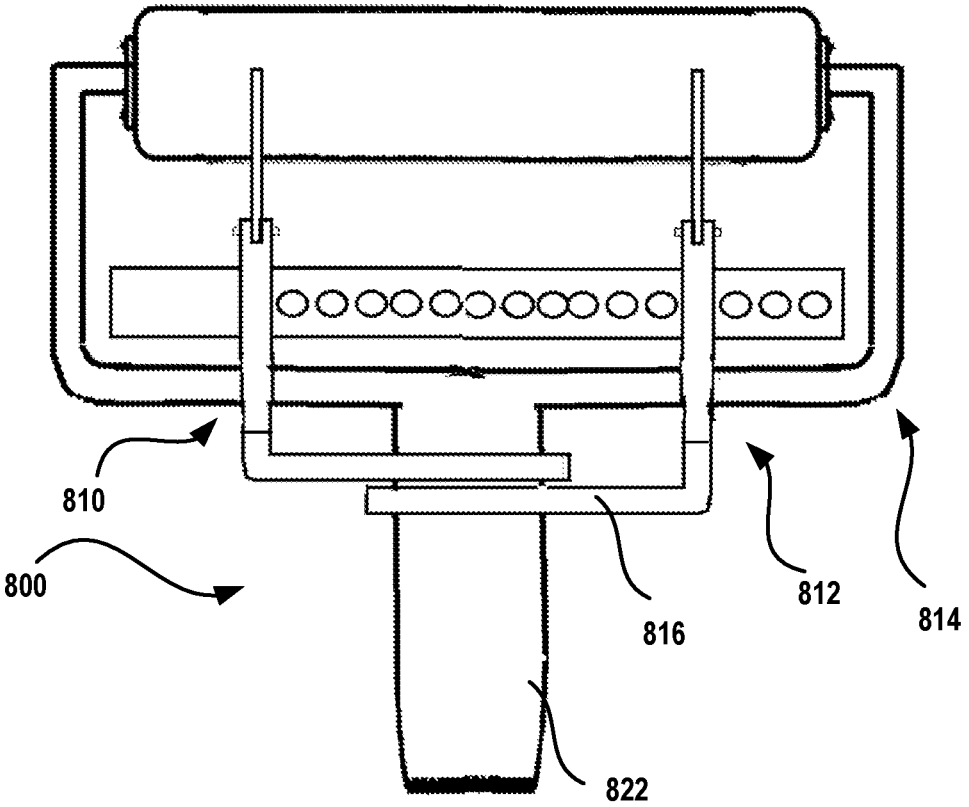
FIG. 15 is a top plan view of another embodiment of pair of stop devices mounted on a double frame paint roller.
Figure 16:
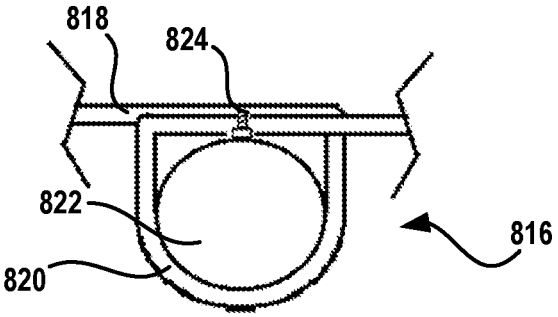
FIG. 16 is a fragmentary cross section view in side elevation of a connecting device mounted on a support for the double frame paint roller shown in FIG. 15.

Referring now to FIGS. 15-16 with continuing reference to the foregoing figures, there is shown another embodiment of a double frame roller assembly, generally designated by the numeral 800. Like the embodiments shown in FIG. 13-14, the double frame roller assembly 800 includes a pair of roller stop devices 810-812 that are essentially identical to the roller stop devices 628-630 shown in FIG. 13 and/or the roller stop devices 710-712 shown in FIG. 14. The roller stop devices 810-812 are mounted on a frame 814.

Unlike the embodiments shown in FIGS. 13-14, the roller stop devices 810-812 can be connected to one another with a connecting device 816 that includes an elongated member 818 that can be bent into a loop 820 for surrounding a vertical support 822 extending from the frame 814. In this exemplary embodiment, the loop 820 encircles the vertical support 822, at least partially. An adjustable fastener 824 can be inserted into the elongated member 818 to adjust the placement of the connecting device 816 on the vertical support 822.

Figure 17:
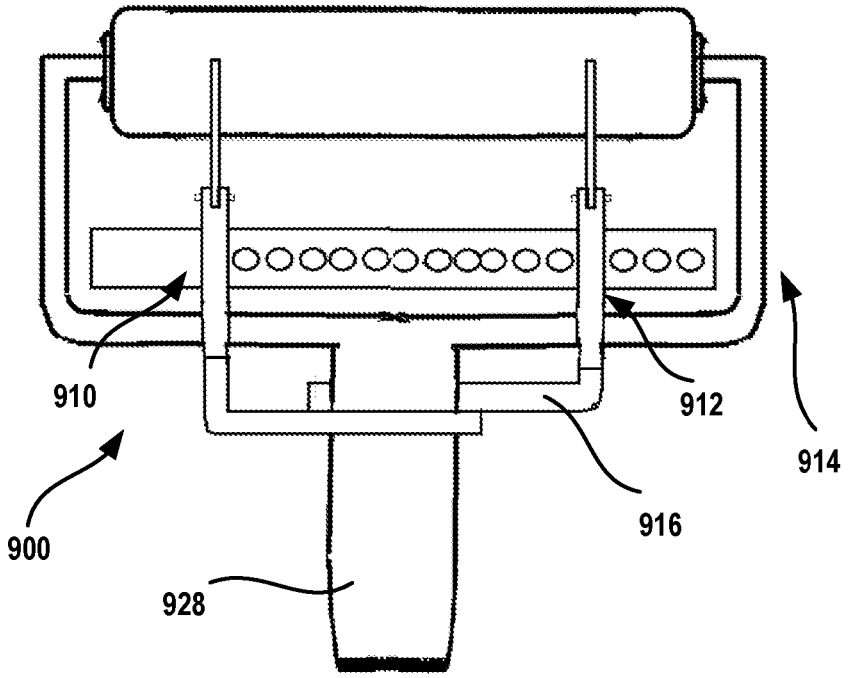
FIG. 17 is a top plan view of another embodiment of pair of stop devices mounted on a double frame paint roller.
Figure 18:
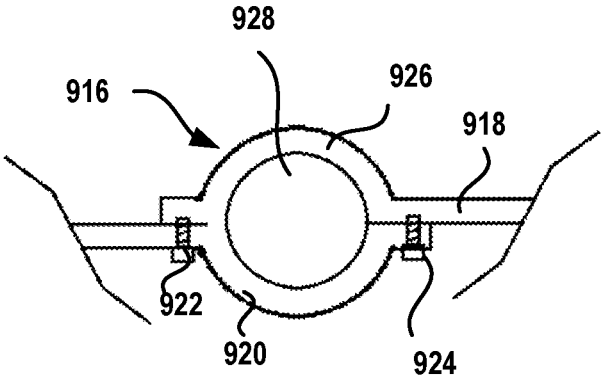
FIG. 18 is a fragmentary cross section view in side elevation of a connecting device mounted on a support for the double frame paint roller shown in FIG. 17.

Referring now to FIGS. 17-18 with continuing reference to the foregoing figures, there is shown another embodiment of a double frame roller assembly, generally designated by the numeral 900. Like the embodiments shown in FIG. 13-16, the double frame roller assembly 900 includes a pair of roller stop devices 910-912 that are essentially identical to the roller stop devices 628-630 shown in FIG. 13, the roller stop devices 710-712 shown in FIG. 14, and/or the roller stop devices 810-812. The roller stop devices 910-912 are mounted on a frame 914.

Unlike the embodiments shown in FIGS. 13-16, the roller stop devices 910-912 can be connected to one another with a connecting device 916 that includes an upper section 918 and a lower section 920. The upper section 918 connects to the lower section 920 with fasteners 922-924 to form a loop 926 for surrounding a vertical support 928 for the frame 914. In this exemplary embodiment, the loop 926 encircles the vertical support 928.

Figure 19:
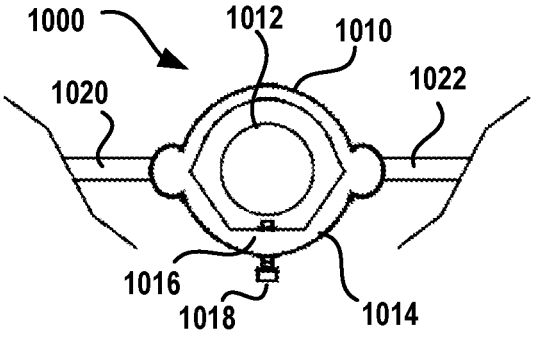
FIG. 19 is a fragmentary cross section view in side elevation of another embodiment of a connecting device.

Referring now to FIG. 19 with continuing reference to the foregoing figures, there is shown another embodiment of a connecting device, generally designated by the numeral 1000. The connecting device 1000 can replace the connecting device 632 shown in FIG. 13, the connecting device 716 shown in FIG. 14, the connecting device 816 shown in FIG. 16 and/or the connecting device 916 shown in FIG. 18.

Unlike the embodiments shown in FIGS. 13-14, 16, and 18, the connecting device 1000 includes an essentially cylindrical tubular section 1010 that includes a hole 1012 for receiving a vertical support, such as the vertical support 928 shown in FIGS. 17-18. A lower portion 1014 of the tubular section 1010 defines a supporting member 1016 having an adjustable fastener 1018 projecting upwardly to engage the vertical support 928. A pair of members 1020-1022 project outwardly from the tubular section 1010.

Figure 20:
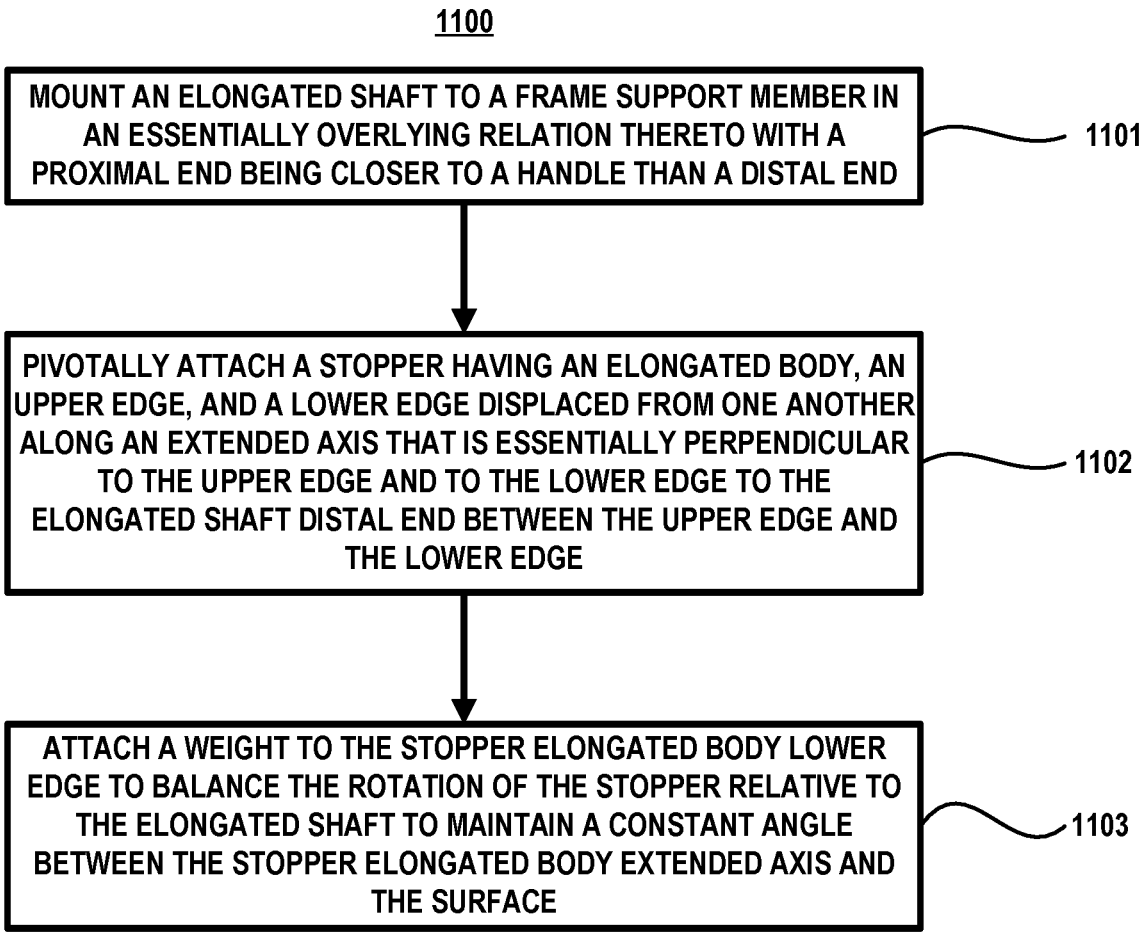
FIG. 20 is a process in accordance with the disclosure.

Referring to FIG. 20 with continuing reference to the foregoing figures, a method 1100 for assembling a stop device in accordance with the described subject matter is shown. Method 1100, or portions thereof, can be performed in association with a paint roller assembly, such as the paint roller assembly 10 shown in FIG. 1, the paint roller assembly 600 shown in FIG. 13, the paint roller assembly 700 shown in FIG. 14, the paint roller assembly 800 shown in FIGS. 15-16 and/or the paint roller assembly 900 shown in FIGS. 17-18 to prevent unwanted contact of a paint roller cover, such as the paint roller cover 26 shown in FIGS. 1-2 and/or the paint roller cover 626 shown in FIG. 13, with a surface adjacent to a surface being painted. The surface can be the surface 122 shown in FIG. 2.

At 1101, the elongated shaft is mounted to the frame support member in an essentially overlying relation thereto with a proximal end being closer to the handle than the distal end. In this exemplary embodiment, the elongated shaft can be the elongated shaft 116 shown in FIG. 1, the elongated shaft 216 shown in FIGS. 3-4, and/or the elongated shafts 638-640 shown in FIG. 13.

At 1102, a stopper having an elongated body, an upper edge, and a lower edge displaced from one another along an extended axis that is essentially perpendicular to the upper edge and to the lower edge is pivotally attached to the elongated shaft distal end between the upper edge and the lower edge. In this exemplary embodiment, the stopper can be the stopper 110 shown in FIGS. 1-2, the stopper 210 shown in FIGS. 3, 6, and 9, the stopper 318 shown in FIG. 10, the stopper 518 shown in FIG. 12, and/or the stoppers 634-636 shown in FIG. 13.

At 1103, a weight is attached to the stopper elongated body lower edge to balance the rotation of the stopper relative to the elongated shaft to maintain a constant angle between the stopper elongated body extended axis and the surface. In this exemplary embodiment, the weight can be the weight 112 shown in FIG. 1, the weight 212 shown in FIGS. 3 and 7, the weight 400 shown in FIG. 8, the weight 510 shown in FIG. 12, and/or the weight 642 shown in FIG. 13.

Supported Features and Embodiments

The detailed description provided above in connection with the appended drawings explicitly describes and supports various features of a paint roller stop device. By way of illustration and not limitation, supported embodiments include a stop device for use with a paint roller frame to prevent unwanted contact of a paint roller with a surface adjacent to a surface being painted, wherein the frame includes a handle and a support member extending therefrom, the stop device comprising: a stopper having an elongated body, an upper edge, and a lower edge, with the upper edge and the lower edge being displaced from one another and being essentially perpendicular to an extended axis along the length of the extended body, a weight attached to the elongated arm essentially adjacent to the lower edge, and an attachment assembly having an elongated shaft and a fastener for attaching the elongated shaft to the frame support member in an essentially overlying relation thereto with a proximal end being closer to the handle than the distal end, wherein the stopper pivotally attaches to the elongated shaft distal end between the upper edge and the lower edge with the weight balancing the rotation of the stopper relative to the elongated shaft to maintain a constant angle between the stopper elongated body extended axis and the surface.

Supported embodiments include the foregoing stop device, wherein the fastener releasably attaches the elongated shaft to the frame support member.

Supported embodiments include any of the foregoing stop devices, wherein the fastener is a clamp.

Supported embodiments include any of the foregoing stop devices, wherein the weight releasably attaches to the stopper.

Supported embodiments include any of the foregoing stop devices, wherein the weight releasably attaches to the elongated shaft when the weight is not maintaining a constant angle between the stopper elongated body extended axis and the surface.

Supported embodiments include any of the foregoing stop devices, wherein the stopper elongated body upper edge extends over the paint roller.

Supported embodiments include any of the foregoing stop devices, wherein the stopper elongated body upper edge extends over a middle portion of the paint roller.

Supported embodiments include any of the foregoing stop devices, wherein the stopper elongated body is essentially flat.

Supported embodiments include any of the foregoing stop devices, wherein the weight has an essentially cylindrical shape and the stopper elongated body lower edge defines an arcuate indentation that receives the weight.

Supported embodiments include any of the foregoing stop devices, wherein the elongated shaft has an essentially bifurcated end that defines a slot for receiving the stopper therein.

Supported embodiments include any of the foregoing stop devices, wherein the stopper includes rigid plastic.

Supported embodiments include any of the foregoing stop devices, wherein the paint roller frame is a double frame and the stop device is mounted on paint roller frame with a second, identical stop device, wherein the weight connects the stop device to the second, identical stop device.

Supported embodiments include a system, a method, an apparatus, and/or means for implementing any of the foregoing stop devices or a portion thereof.

Supported embodiments include a method for assembling a stop device for use with a paint roller frame to prevent unwanted contact of a paint roller with a surface adjacent to a surface being painted, wherein the frame includes a handle and a support member extending therefrom, the method comprising: mounting the elongated shaft to the frame support member in an essentially overlying relation thereto with a proximal end being closer to the handle than the distal end, pivotally attaching a stopper having an elongated body, an upper edge, and a lower edge, with the upper edge and the lower edge being displaced from one another and being essentially perpendicular to an extended axis along the length of the extended body to the elongated shaft distal end between the upper edge and the lower edge, and attaching a weight to the stopper elongated body lower edge to balance the rotation of the stopper relative to the elongated shaft to maintain a constant angle between the stopper elongated body extended axis and the surface.

Supported embodiments include the foregoing method, further comprising: releasably mounting the elongated shaft to the frame support member.

Supported embodiments include any of the foregoing methods, further comprising: releasably attaching a weight to the stopper elongated body lower edge.

Supported embodiments include any of the foregoing methods, further comprising: extending the stopper elongated body upper edge over the paint roller.

Supported embodiments include any of the foregoing methods, further comprising: extending the stopper elongated body upper edge over a middle portion of the paint roller.

Supported embodiments include any of the foregoing methods, wherein the stopper elongated body is essentially flat.

Supported embodiments include any of the foregoing methods, wherein the weight has an essentially cylindrical shape and the stopper elongated body lower edge defines an arcuate indentation that receives the weight.

Supported embodiments include any of the foregoing methods, further comprising: pivotally mounting the stopper within a slot formed on a bifurcated end of the elongated shaft.

Supported embodiments include a system, an apparatus, and/or means for implementing any of the foregoing methods or a portion thereof.

Supported embodiments include a kit for use with a paint roller frame to prevent unwanted contact of a paint roller with a surface adjacent to a surface being painted, wherein the frame includes a handle and a support member extending therefrom, the kit comprising: a stopper having an elongated body, an upper edge, and a lower edge, with the upper edge and the lower edge being displaced from one another and being essentially perpendicular to an extended axis along the length of the extended body, a weight for attaching to the elongated arm essentially adjacent to the lower edge, and an attachment assembly having an elongated shaft and a fastener for attaching the elongated shaft to the frame support member in an essentially overlying relation thereto with a proximal end being closer to the handle than the distal end, wherein the stopper has the ability to pivotally attach to the elongated shaft distal end between the upper edge and the lower edge with the weight balancing the rotation of the stopper relative to the elongated shaft to maintain a constant angle between the stopper elongated body extended axis and the surface.

Supported embodiments include the foregoing kit, wherein the fastener can releasably attach the elongated shaft to the frame support member.

Supported embodiments include any of the foregoing kits, wherein the fastener is a clamp.

Supported embodiments include any of the foregoing kits, wherein the weight releasably attaches to the stopper.

Supported embodiments include any of the foregoing kits, wherein the weight can releasably attach to the elongated shaft when the weight is not maintaining a constant angle between the stopper elongated body extended axis and the surface.

Supported embodiments include any of the foregoing kits, wherein the stopper elongated body is essentially flat.

Supported embodiments include any of the foregoing kits, wherein the weight has an essentially cylindrical shape and the stopper elongated body lower edge defines an arcuate indentation that receives the weight.

Supported embodiments include any of the foregoing kits, wherein the elongated shaft has an essentially bifurcated end that defines a slot for receiving the stopper therein.

Supported embodiments include any of the foregoing kits, wherein the stopper includes rigid plastic.

Supported embodiments include a system, a method, an apparatus, and/or means for implementing any of the foregoing kits or a portion thereof.

Supported embodiments can provide various attendant and/or technical advantages in terms of a stop device that prevents a paint roller from hitting the ceiling or the crown molding and stops the roller at the same exact distance every single time.

Supported embodiments include a stop device that produces a top paint line that can be as close to the corners and as straight as possible.

Supported embodiments include a stop device that allow a paint roller to operate in a more consistent and efficient manner.

Supported embodiments include a stop device that can be configured in a folded configuration for storage and that can be disassembled for easy cleaning.

Supported embodiments include a stop device that includes a pivotally attached stopper that is balanced to prevent the stopper from being dipped into paint when a roller cover is dipped into paint.

The detailed description provided above in connection with the appended drawings is intended as a description of examples and is not intended to represent the only forms in which the present examples can be constructed or utilized.

It is to be understood that the configurations and/or approaches described herein are exemplary in nature, and that the described embodiments, implementations and/or examples are not to be considered in a limiting sense, because numerous variations are possible.

The specific processes or methods described herein can represent one or more of any number of processing strategies. As such, various operations illustrated and/or described can be performed in the sequence illustrated and/or described, in other sequences, in parallel, or omitted. Likewise, the order of the above-described processes can be changed.

Although the subject matter has been described in language specific to structural features and/or methodological acts, it is to be understood that the subject matter defined in the appended claims is not necessarily limited to the specific features or acts described above. Rather, the specific features and acts described above are presented as example forms of implementing the claims.

What is claimed is:

1. A paint roller frame assembly for preventing unwanted contact of a paint roller with a surface adjacent to a surface being painted, the paint roller frame assembly comprising:

a frame having a handle and a support member extending therefrom, and a stop device having a stopper, a weight, and an attachment assembly, wherein the stopper has an elongated body, an upper edge, and a lower edge, with the upper edge and the lower edge being displaced from one another and being essentially perpendicular to an extended axis along the length of the elongated body, wherein the weight is attached to the elongated body essentially adjacent to the lower edge wherein the attachment assembly has an elongated shaft and a fastener for attaching the elongated shaft to the frame support member in an essentially overlying relation thereto with a proximal end being closer to the handle than the distal end, and wherein the stopper pivotally attaches to the elongated shaft distal end between the upper edge and the lower edge with the weight balancing the rotation of the stopper relative to the elongated shaft to maintain a constant angle between the stopper elongated body extended axis and the surface.

2. The paint roller frame assembly of claim 1, wherein the fastener releasably attaches the elongated shaft to the frame support member.

3. The paint roller frame assembly of claim 1, wherein the fastener is a clamp.

4. The paint roller frame assembly of claim 1, wherein the weight releasably attaches to the stopper.

5. The paint roller frame assembly of claim 4, wherein the weight releasably attaches to the elongated shaft when the weight is not maintaining a constant angle between the stopper elongated body extended axis and the surface.

6. The paint roller frame assembly of claim 1, wherein the stopper elongated body upper edge extends over the paint roller.

7. The paint roller frame assembly of claim 6, wherein the stopper elongated body upper edge extends over a middle portion of the paint roller.

8. The paint roller frame assembly of claim 1, wherein the stopper elongated body is essentially flat.

9. The paint roller frame assembly of claim 8, wherein the weight has an essentially cylindrical shape and the stopper elongated body lower edge defines an arcuate indentation that receives the weight.

10. The paint roller frame assembly of claim 8, wherein the elongated shaft has an essentially bifurcated end that defines a slot for receiving the stopper therein.

11. The paint roller frame assembly of claim 1, wherein the stopper includes rigid plastic.

12. The paint roller frame assembly of claim 1, wherein the paint roller frame is a double frame and the stop device is mounted on paint roller frame with a second, identical stop device, wherein the weight connects the stop device to the second, identical stop device.

13. A method for assembling a stop device for use with a paint roller frame to prevent unwanted contact of a paint roller with a surface adjacent to a surface being painted, wherein the frame includes a handle and a support member extending therefrom, the method comprising:

mounting an elongated shaft to the frame support member in an essentially overlying relation thereto with a proximal end being closer to the handle than the distal end, pivotally attaching a stopper having an elongated body, an upper edge, and a lower edge, with the upper edge and the lower edge being displaced from one another and being essentially perpendicular to an extended axis along the length of the extended body to the elongated shaft distal end between the upper edge and the lower edge, and attaching a weight to the stopper elongated body lower edge to balance the rotation of the stopper relative to the elongated shaft to maintain a constant angle between the stopper elongated body extended axis and the surface.

14. The method of claim 13, further comprising:

releasably mounting the elongated shaft to the frame support member.

15. The method of claim 14, further comprising:

releasably attaching a weight to the stopper elongated body lower edge.

16. The method of claim 13, further comprising:

extending the stopper elongated body upper edge over the paint roller.

17. The method of claim 16, further comprising:

extending the stopper elongated body upper edge over a middle portion of the paint roller.

18. The method of claim 13, wherein the stopper elongated body is essentially flat.

19. The method of claim 18, wherein the weight has an essentially cylindrical shape and the stopper elongated body lower edge defines an arcuate indentation that receives the weight.

20. The method of claim 18, further comprising:

pivotally mounting the stopper within a slot formed on a bifurcated end of the elongated shaft.

* * * * *